US007850576B2

(12) United States Patent
Sellke

(10) Patent No.: US 7,850,576 B2
(45) Date of Patent: Dec. 14, 2010

(54) PORTABLE ASSEMBLY FOR SPORTS SKILL DEVELOPMENT OR RECREATION AND METHODS RELATED THERETO

(75) Inventor: Adam R. Sellke, Golden Valley, MN (US)

(73) Assignee: Madoi, LLC, Golden Valley, MN (US)

( * ) Notice: Subject to any disclaimer, the term of this patent is extended or adjusted under 35 U.S.C. 154(b) by 864 days.

(21) Appl. No.: 11/623,133

(22) Filed: Jan. 15, 2007

(65) Prior Publication Data

US 2007/0176369 A1 Aug. 2, 2007

Related U.S. Application Data

(66) Substitute for application No. 60/743,186, filed on Jan. 28, 2006.

(51) Int. Cl.

| | |
|---|---|
| ***A63B 71/00*** | (2006.01) |
| ***A63B 21/00*** | (2006.01) |
| ***A63B 63/00*** | (2006.01) |
| ***A61H 3/04*** | (2006.01) |
| ***F41J 1/10*** | (2006.01) |

(52) U.S. Cl. ..... 482/51; 482/68; 482/132; 273/407; 473/478

(58) Field of Classification Search ..... 482/51, 482/66, 68, 131, 132, 141, 95, 96; 473/195–197, 473/446, 469–471, 476, 478; 273/407, 408; 280/1.5; 135/67

See application file for complete search history.

(56) References Cited

U.S. PATENT DOCUMENTS

| | | | | | |
|---|---|---|---|---|---|
| 2,449,708 | A | | 9/1948 | Lindsay | |
| 2,565,257 | A | * | 8/1951 | Nichol | 482/68 |
| 4,021,033 | A | * | 5/1977 | Auclair et al. | 482/66 |
| 4,226,413 | A | * | 10/1980 | Daugherty | 482/67 |
| 5,033,734 | A | | 7/1991 | Jalbert | |
| 5,271,422 | A | * | 12/1993 | Sorrell et al. | 135/66 |
| 5,275,187 | A | * | 1/1994 | Davis | 135/67 |
| 5,347,666 | A | * | 9/1994 | Kippes | 5/81.1 R |
| 5,397,154 | A | | 3/1995 | Baldwin | |
| 5,433,235 | A | * | 7/1995 | Miric et al. | 135/67 |
| 5,539,957 | A | * | 7/1996 | Schmidt | 16/331 |
| 5,566,952 | A | * | 10/1996 | Mullin et al. | 273/400 |
| 5,655,774 | A | * | 8/1997 | Cox | 473/478 |
| 5,681,045 | A | * | 10/1997 | Liao | 273/400 |

(Continued)

*Primary Examiner*—Loan Thanh
*Assistant Examiner*—Allana Lewin
(74) *Attorney, Agent, or Firm*—Schwegman Lundberg & Woessner, P.A.

(57) ABSTRACT

A portable support or goal assembly includes, among other things, a top frame portion, a base frame portion, two or more post frame members, and a plurality of releasably lockable hinge connectors. The portable support assembly provides support for a user and includes a U-shaped top frame portion configured to be gripped by the user and a U-shaped base frame portion having wheels or low-friction feet to facilitate mobility on a support surface. The goal assembly provides a U-shaped goal opening defined by an aligned top frame portion supported at each end by vertically extending side post members, the latter of which are attached to a U-shaped base frame portion. In one example, the top and base frame portions, the post frame members, and the hinge connectors are reconfigurable between the support assembly, the goal assembly, and a collapsed orientation. Also discussed is a method for assembly reconfiguration.

8 Claims, 7 Drawing Sheets

U.S. PATENT DOCUMENTS

| | | | | |
|---|---|---|---|---|
| 5,902,196 | A | 5/1999 | Chomeyko et al. | |
| 6,170,840 | B1 * | 1/2001 | Mathias | 280/87.041 |
| 6,371,873 | B1 * | 4/2002 | Wang | 473/478 |
| 6,402,643 | B1 * | 6/2002 | Gill | 473/478 |
| 6,419,311 | B1 | 7/2002 | Tang | |
| 6,652,395 | B2 * | 11/2003 | Goldwitz | 473/478 |
| 6,712,744 | B2 | 3/2004 | Buechel, Jr. et al. | |
| 6,766,623 | B1 | 7/2004 | Kalnay | |
| D504,710 | S * | 5/2005 | Kimball | D21/771 |
| 6,979,274 | B1 | 12/2005 | Raber | |
| 7,017,996 | B2 | 3/2006 | Peterson | |
| 7,371,195 | B2 * | 5/2008 | Stevens | 473/478 |
| 2001/0045227 | A1 | 11/2001 | Balan | |
| 2004/0192516 | A1 | 9/2004 | Buechel, Jr. et al. | |

* cited by examiner

PORTABLE ASSEMBLY FOR SPORTS SKILL DEVELOPMENT OR RECREATION AND METHODS RELATED THERETO

CLAIM OF BENEFIT OF PRIOR-FILED APPLICATION

This patent application claims the benefit of U.S. Provisional Application Ser. No. 60/743,186, entitled "SKATING AND SPORTS SKILL DEVELOPMENT APPARATUS," filed on Jan. 28, 2006, under 35 U.S.C. §119(e), which is hereby incorporated by reference in its entirety.

TECHNICAL FIELD

This patent document pertains generally to sport skill development or recreation. More particularly, but not by way of limitation, this patent document pertains to a portable assembly aiding a user's skating development or providing a sporting goal to the user.

BACKGROUND

Beginning or disabled skaters, both young and old, may experience considerable difficulty in mastering the sport's balancing aspect, often out of fear of falling and thereby suffering injury. After an individual suffers a fall, he or she often becomes so afraid of such an experience replicating itself, that he or she gives up trying to learn to skate or, at the very least, becomes so cautious that the skating learning process is slow and lengthy. This is particularly true in the case of older people who know that a single fall can result in broken bones or other serious injury, and also younger people who may be very hesitant to attempt skating in the first place.

In general, individuals learning to skate like the security of holding onto someone, especially a perceived experienced skater, but even this does not insure against an occasional fall due to the awkwardness of such a holding scheme. Additionally, an experienced skater may not be available when needed or may not have the time and patience required to teach the beginner or disabled skater. In either case, since development of self-confidence is an essential ingredient of the skating learning process, the beginner or disabled skater should not continue to lean on someone for security, but instead, go at it alone as soon as possible.

Ice hockey and other goal-oriented sports, such as soccer, roller hockey, and lacrosse, are considered among the fastest growing sports in the United States and elsewhere, particularly in regard to youth participation. Unfortunately, the practice environment for such sports is not ideal. This is especially true in the informal practice environment, outside the realm of organized league sports. While many recreational facilities have soccer or ice hockey goals, the nets are usually only attached when official league games are being played to guard against theft and wear and tear. In addition, standard, non-portable soccer or ice hockey goals are designed for fully-sided games featuring ten or more players, which is usually too many to assemble for a typical "pick-up" game. The situation is no better for lacrosse players or participants in other goal-oriented sports.

Even in formal practice environments, the need for smaller goals is great. One reason for this is limited field or ice space. By using a shortened playing surface, coaches may have many practice games going on at once. Such practice games have become a staple in soccer and ice hockey training, not only because of their convenience, but because such games allow players to receive the ball or puck more often, and place a greater emphasis on speed, ball/puck control, teamwork and decision-making. Also, these "small-sided games" can easily be conducted indoors during the winter months.

Portable goals consisting of numerous pieces have the distinct disadvantage of being difficult and slow to set up. For instance, loose fasteners may require tools for driving or tightening, and may also become lost in transit or storage or during assembly of the goal on the playing surface. In addition, the assembly of such portable goals is difficult for younger children to complete by themselves.

What is needed is a simple, low cost, adjustable, and portable assembly capable for use in the instruction of, or individual use by, a beginning or disabled skater. What is further needed is a simple, low cost, adjustable, and portable assembly providing a sporting goal for hockey, soccer, or other goal-oriented sports.

SUMMARY

Certain examples of the present subject matter include a collapsible support assembly comprising a generally U-shaped top frame portion, a generally U-shaped base frame portion, and two or more post frame members. The top frame portion includes two or more top side-arm members and a linking top cross-bar member coupled to the top side-arm members via at least one releasably lockable hinge connector. The base frame portion includes two or more base side-arm members spaced a greater distance apart than the top side-arm members and a linking base cross-bar member coupled to the base side-arm members via at least one releasably lockable hinge connector. The post frame members include at least two side post members each of which is coupled between the base frame portion on a lower end and the top frame portion on an upper end.

Certain examples of the present subject matter include a goal assembly comprising a U-shaped goal opening, a base frame portion, and a net. The U-shaped goal opening is defined by a top frame portion supported at each end by vertically extending side post members coupled thereto via releasably lockable hinge connectors. The top frame portion comprises at least two top side-arm members and a top cross-bar member aligned with one another and coupled via releasably lockable hinge connectors. The base frame portion includes a pair of base side-arm members and a base cross-bar member. Each of the base side-arm members rearwardly extend from, and couple to via a releasably lockable hinge connector, the lower end of each side post member and each having a rear end pivotably coupled to an end of the base cross-bar member. Certain examples of the goal assembly further comprise a diagonal middle post member coupled to the base cross-bar member on a lower end and coupled to the top frame portion on an upper end.

Certain examples of the present subject matter include a reconfigurable assembly comprising a top frame portion, a base frame portion, and two or more post frame members coupled between the top frame portion and the base frame portion. The top frame portion, the base frame portion, and the two or more post frame members comprise a support assembly configuration in a first instance and a goal assembly configuration in a second instance.

Certain examples of the present subject matter include a method comprising forming one of a support assembly or a goal assembly and locking an orientation of one or more members of such assembly. Forming the support assembly or the goal assembly includes expanding from a compact orientation a top frame portion, a base frame portion, and two or more post frame members. The top frame portion includes at least two top side-arm members rotatably coupled to a top cross-bar member. The base frame portion includes at least two base side-arm members rotatably coupled to a base cross-bar member. The two or more post frame members include at least two side post members rotatably coupled between the top frame portion and the base frame portion.

Advantageously, the present assemblies and methods include a reconfigurable, collapsible structure providing one or both of a support function or a sporting goal function to a user. As a result of its collapsible nature and optionally tubular design, each assembly is lightweight and easily portable. These and other examples, advantages, and features of the present assemblies and methods will be set forth in part in the detailed description, which follows, and in part will become apparent to those skilled in the art by reference to the following description of the present assemblies, methods, and drawings or by practice of the same.

BRIEF DESCRIPTION OF THE DRAWINGS

In the drawings, which are not necessarily drawn to scale, like numerals describe similar components throughout the several views. The drawings illustrate generally, by way of example, but not by way of limitation, various embodiments discussed in the present document.

DETAILED DESCRIPTION

The following detailed description includes references to the accompanying drawings, which form a part of the detailed description. The drawings show, by way of illustration, specific embodiments in which the present assemblies and methods may be practiced. These embodiments, which are also referred to herein as "examples," are described in enough detail to enable those skilled in the art to practice the present assemblies and methods. The embodiments may be combined, other embodiments may be utilized or structural or logical changes may be made without departing from the scope of the present assemblies and methods. The following detailed description is, therefore, not to be taken in a limiting sense and the scope of the present assemblies and methods are defined by the appended claims and their legal equivalents.

In this document, the terms "a" or "an" are used to include one or more than one; and the term "or" is used to refer to a nonexclusive "or" unless otherwise indicated. In addition, it is to be understood that the phraseology or terminology employed herein, and not otherwise defined, is for the purpose of description only and not of limitation.

The present assemblies and methods include a reconfigurable, collapsible structure providing one or both of a support function or a sporting goal function to a user. As a result of its collapsible and optionally tubular design, each assembly is lightweight and compact (when collapsed) and thus, is easily movable from one location to another. For instance, each assembly may collapse so-as-to easily fit in a trunk or back seat of a car or may be carried by the user. Among other advantageous characteristics, the present assemblies provide a simple and inexpensive construction, which may easily be assembled for use by children and adults.

Figure 1:
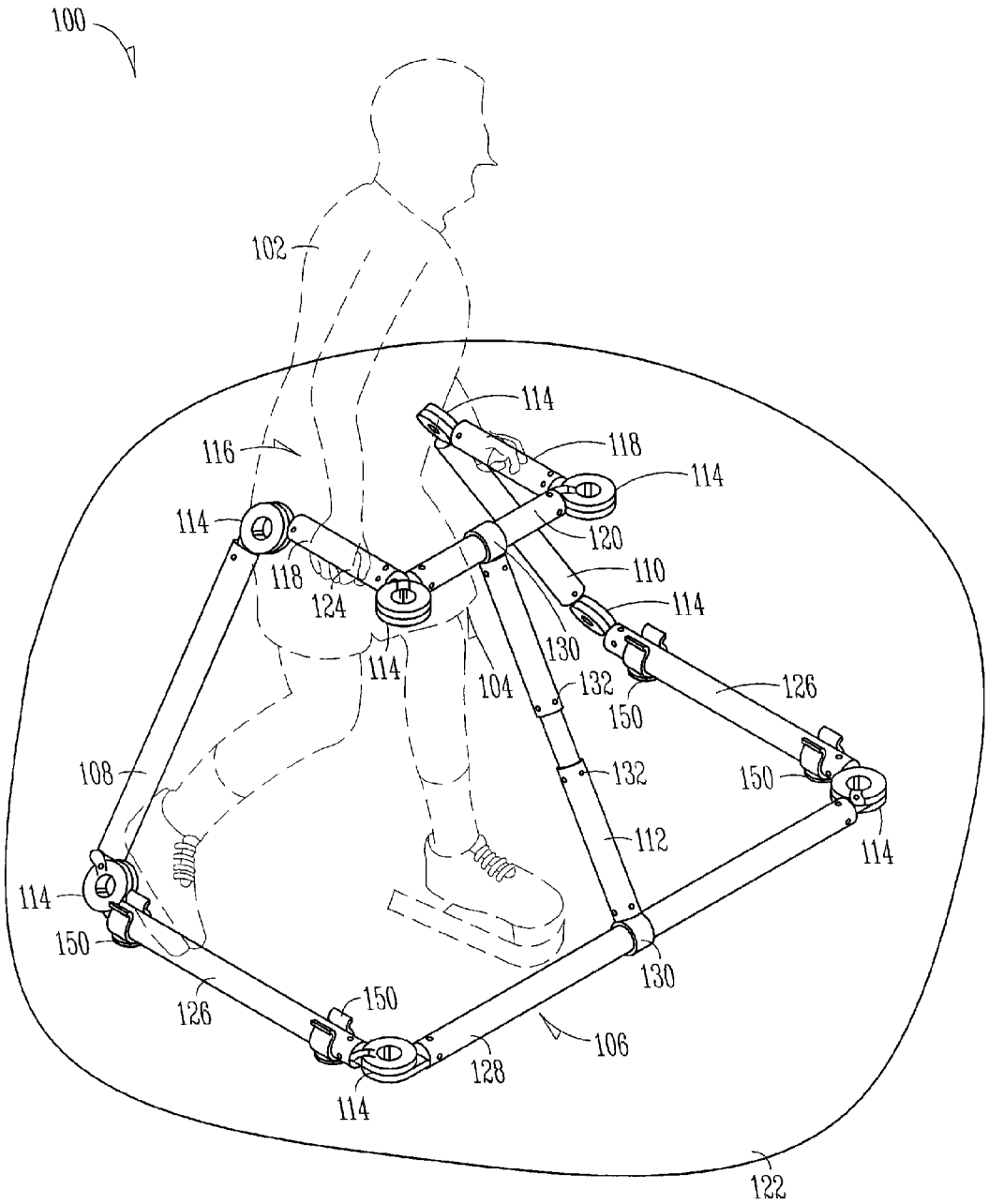
FIG. 1 is a schematic view of a portable support assembly for sports skill development shown in an expanded configuration and a user using the same, as constructed in accordance with at least one embodiment.

FIG. 1 illustrates a portable support assembly 100 for sports or other skill development. The support assembly 100 is designed to support a portion of a user's 102 weight. For instance, the support assembly 100 may provide skating assistance to a user 102 who has balance difficulty or has weakness in his/her lower extremities. By using the support assembly 100, the user may learn the fundamentals of skating (e.g., the balancing aspect) without unduly interfering with his/her freedom of movement. In the example shown, but as may vary, the support assembly 100 includes a generally U-shaped top frame portion 104, a generally U-shaped base frame portion 106, three post frame members 108, 110, 112, and a plurality of releasably lockable hinge connectors 114.

The generally U-shaped top frame portion 104 is open at the rear 116 and, in the example shown, includes parallel top side-arm members 118 and a linking top cross-bar member 120 perpendicular to the top side-arm members 118. The top cross-bar member 120 is coupled to the top side-arm members 118 on each end using a releasably lockable hinge connector 114 (see also, FIGS. 7A, 7B). Each of the top side-arm members 118 and the top cross-bar member 120 is positioned and oriented to be grabbed by the user 102, such as when he/she moves on a support surface 122 (e.g., ice or a sidewalk), thereby steadying themselves. To this end, the top side-arm members 118 may include a gripping section 124 placed at an ergonomically-correct position thereby guiding the user 102 where he/she should optimally position his/her hands for proper support. In certain examples, the gripping section 124 includes rubber, foam, or any other resilient and conformable material. For protection from cold metal tubing, such as may occur when the support assembly 100 is used for ice-skating support, the gripping section 124 may include a thermal insulator, which may take the form of a thin-walled sleeve of foamed plastic or rubber.

In the example shown, the generally U-shaped base frame portion 106 includes parallel base side-arm members 126 and a linking base cross-bar member 128 generally perpendicular to the base side-arm members 126. The base cross-bar member 128 is coupled to the base side-arm members 126 on each end using a releasably lockable hinge connector 114. The base side-arm members 126 are spaced a greater distance apart than the top side-arm members 118, thereby allowing the user 102 to skate, for example, in a natural and non-limiting skating manner. As further discussed below, one or more low-friction feet 150 or wheels 300 may be clamped or otherwise removably attached (e.g., via a ball and socket connection scheme) to the base frame portion 106.

The three post frame members 108, 110, 112 include two side post members 108, 110 and a middle post member 112, each of which extend upward from the base frame portion 106 at an angle to a plane of the base frame. The post frame members 108, 110, 112 are coupled to the base frame portion 106 on respective lower ends and are coupled to the top frame portion 104 on respective upper ends. As shown, the side post members 108, 110 may be coupled to the top 104 and base 106 frame portions using releasably lockable hinge connectors 114, and the middle post member 112 may be slidably coupled to the frame portions using one or more collar mounting brackets 130. While the example of FIG. 1 includes three post frame members, the portable support assembly 100 is not limited thereto. For instance, the portable supply assembly 100 may include more or less than three post frame members, such as two or more post frame members.

The support assembly 100 may include size adjustment capabilities, thereby allowing the user 102 to adjust the assembly to a desired support height or orientation. In the example shown, the middle post member 112 includes at least two adjustable telescoping members having a plurality of spaced apart apertures 132 and a locking device 502 (FIG. 5) removably insertable therethrough when aligned. The locking device 502 is configured to releasably hold the top frame portion 104 at a predetermined height or orientation relative to the base frame portion 106. By adjusting the middle post member 112 using the plurality of apertures 132 and the locking device 502, the height and orientation of the top frame portion 104, to which the user grabs onto for support, may easily be adjusted. As shown, but as may vary, an orientation of the top frame portion 104 and an orientation of the base frame portion 106 are substantially parallel.

One or more of the top frame portion 104, the base frame portion 106, or the post frame members 108, 110, 112 may include a hollow, tubular construction. The tubing may be composed of a variety of materials or include a variety of shapes and sizes. In certain examples, the tubing is composed of a polymer, such as PVC, or a metal, such as aluminum or steel. In certain examples, a cross-sectional shape of the tubing is round, square, hexagonal, or octagonal. Notably, however, the present subject matter is not limited to the foregoing options as the tubing may also be manufactured in other shapes or sizes or be composed of other materials which can adequately support a portion of the user's 102 weight.

While the particular dimensions of the elements included in the support assembly 100 may vary, in one example, the dimensions are as follows. The top frame portion 104 includes two top side-arm members 118 measuring about 10" in length and a top cross-bar member 120 measuring about 14.45" in length. The base frame portion 106 includes two base side-arm members 126 measuring about 24" in length and a base cross-bar member 128 measuring about 43" in length. The side post members 108, 110 measure about 24" in length, while the middle post member 112 includes telescoping members about 12-24" in length. Advantageously, the support assembly 100 is capable of being collapsed easily and in a manner which permits the entire assembly to be stored and transported in a compact configuration (see, e.g., FIG. 8).

Figure 2:
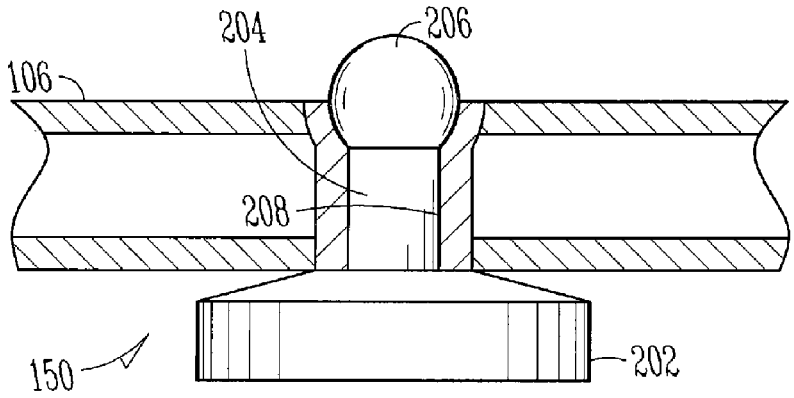
FIG. 2 is a partial cross-sectional view of a base frame portion of a portable support assembly and a low-friction foot removably attached thereto, as constructed in accordance with at least one embodiment.
Figure 3:
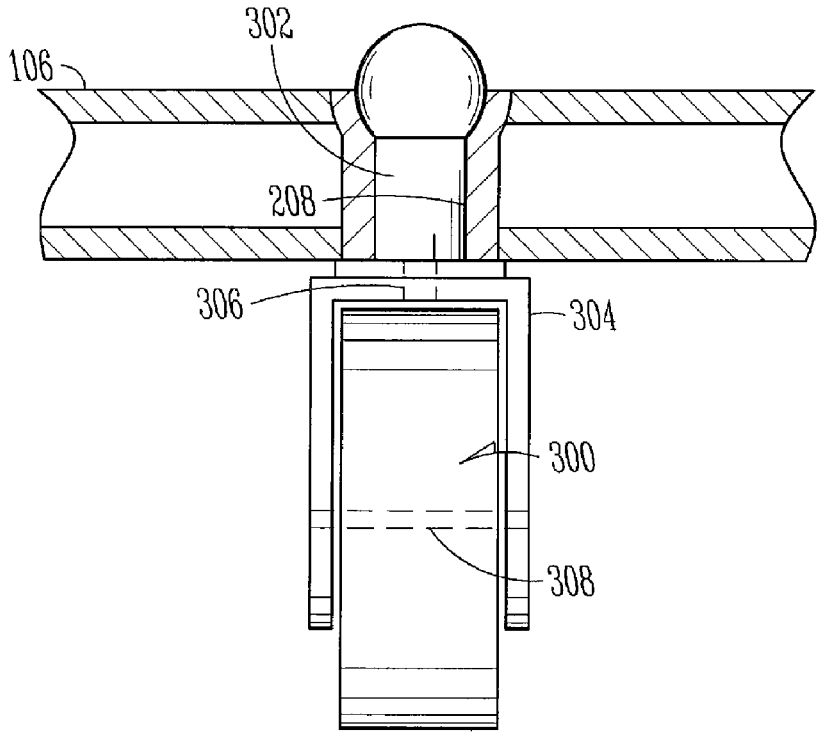
FIG. 3 is a partial cross-sectional view of a base frame portion of a portable support assembly and a wheel removably attached thereto, as constructed in accordance with at least one embodiment.

FIGS. 2-3 illustrate one example of a low-friction foot 150 and a roller wheel 300, respectively, which may be attached to the support assembly 100 (FIG. 1), specifically the base frame portion 106 (shown in cross-section), to facilitate movement of the assembly 100 (FIG. 1) on a support surface 122 (FIG. 1). For instance, when used on relatively frictionless surfaces, such as ice, one or more low-friction feet 150 may be removably attached to the base frame portion 106 to provide easy movement of the assembly 100 on the support surface 122 and to protect base portions of the assembly from wear and tear. When used on friction-bearing surfaces, such as a sidewalk, the low-friction feet 150 may be detached with one or more roller wheels 300 attached to the base frame portion 106 in their place. In brief, the make-up of the support surface 122 may dictate which of the one or more feet 150, wheels 300, or other movement facilitating means is preferable in a given environment.

The low-friction foot 150 illustrated in FIG. 2 includes a horizontal disc 202 and a stem 204. The stem 204 has an enlarged head 206 which snap-fits into a socket 208 provided in the base frame portion 106. The socket 208 may also be used to support a roller wheel 300, such as is illustrated in FIG. 3. Each roller wheel 300, like each low-friction foot, may include a stein 302 which is received in the socket 208, a bracket 304 pivoted by a pin 306 on the bottom of the stem 302, and the roller wheel 300 is carried by its shaft 308 on the bracket. As shown, each foot 150 and roller wheel 300 may be positioned on the underside of the base frame portion 106 (when coupled thereto), thereby separating the base frame portion 106 from the support surface 122.

Figure 4:
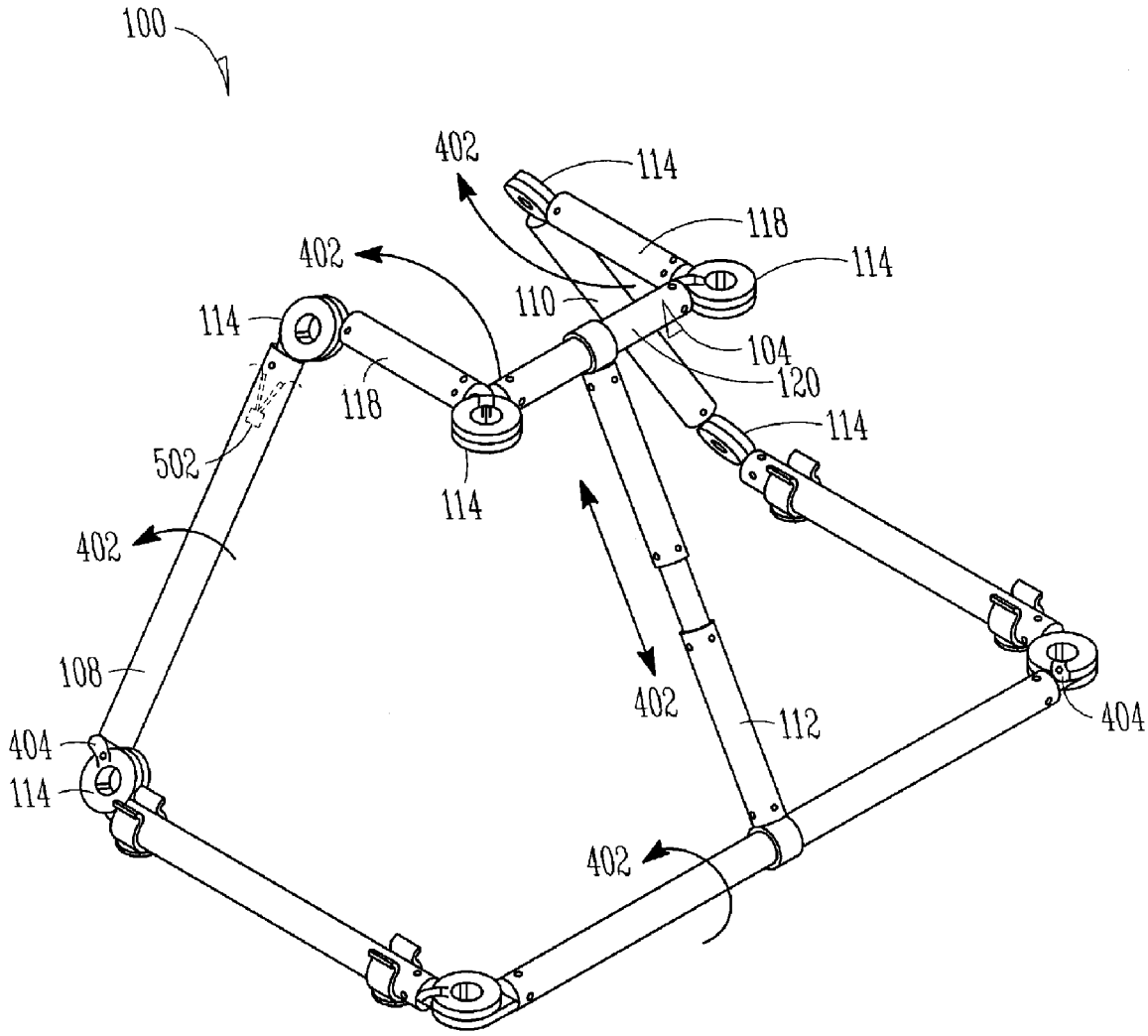
FIG. 4 is an isometric view of a portable support assembly for sports skill development shown in an expanded configuration and a plurality of configuration-changing indicative arrows, as constructed in accordance with at least one embodiment.

FIG. 4 is an isometric view of a portable support assembly 100 and a plurality of configuration-changing indicative arrows 402. In addition to being collapsible (see, e.g., FIG. 8), the present assembly may also be reconfigurable between the support assembly 100 and a goal assembly 500 (FIG. 5), if desired, without the use of tools. Such transformation may be made by unlocking a rotational ability of the releasably lockable hinge connectors 114 (e.g., by simply lifting a tab 404 of each hinge) and an orientation of each hinge 114 relative to the tubular frame member to which it is attached (e.g., by depressing a locking device 502 and rotation). Once unlocked, a top frame portion 104, such as two top side-arm members 118 and a top cross-bar member 120, may be pivoted from a general U-shape into longitudinal alignment with one another. This movement of the top side-arm members 118 and the top cross-bar member 120 results in a lengthening and change in orientation (relative to a plane of the base frame member) of a middle post member 112 and a more vertical orientation of two side post members 108, 110. It will be readily appreciated by those skilled in the art that the progression of the assembly from the support orientation 100 to the goal assembly 500 may be attained through other sequences of events than those set forth herein.

Figure 5:
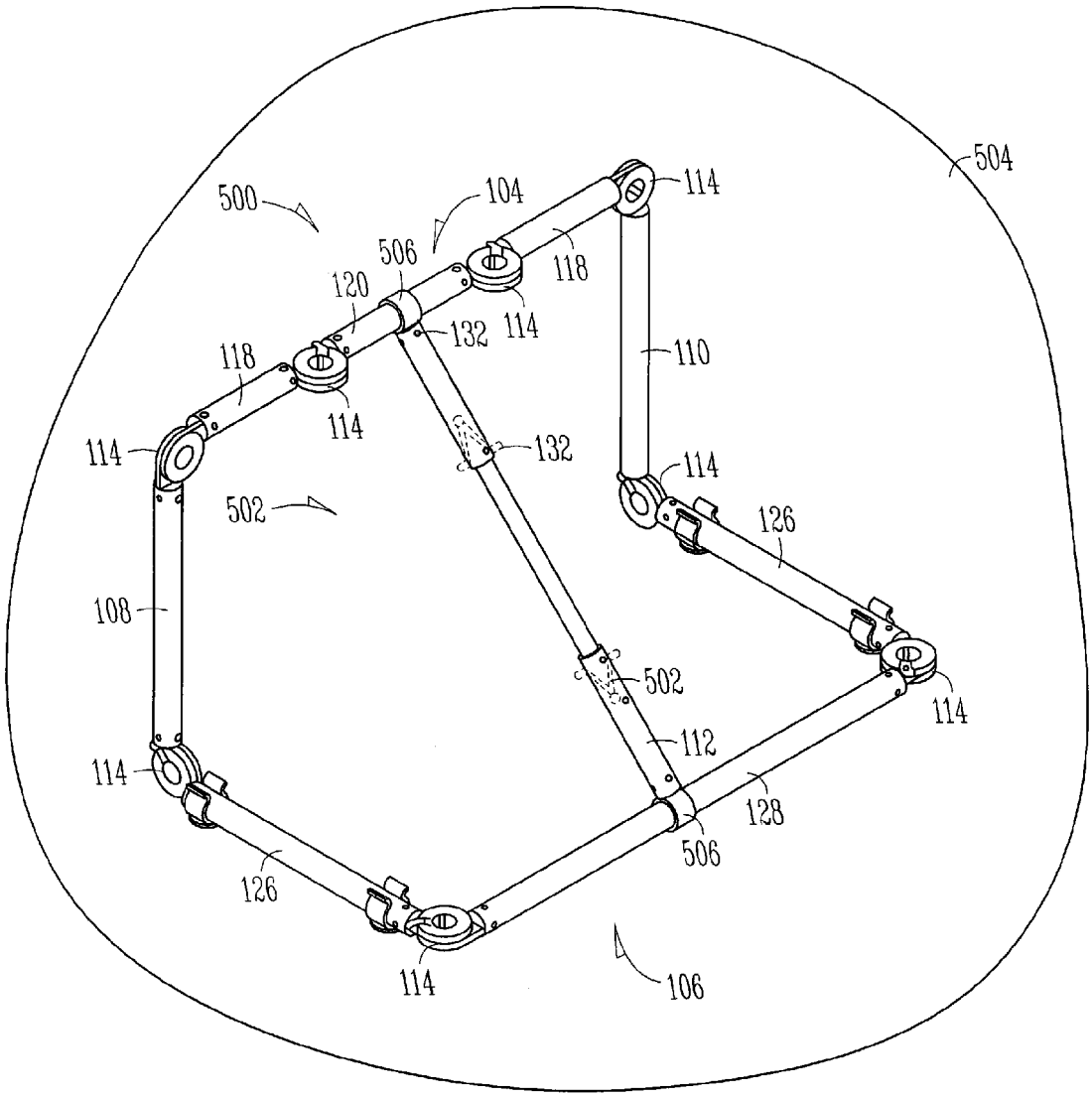
FIG. 5 is an isometric view of a portable goal assembly for sporting recreation shown without a net and in an expanded configuration, as constructed in accordance with at least one embodiment.

FIG. 5 illustrates a goal assembly 500 for sporting recreation, which is portable and may be put together with ease by users of various ages without the need for tools. The goal assembly includes a top frame portion 104, a base frame portion 106, two vertically oriented side post members 108, 110 and optionally at least one middle post member 112. The top frame portion 104 and the two side post members 108, 110 combine to define a U-shaped goal opening 502 and are coupled via releasably lockable hinge connectors 114. When a lower portion of each side post member 108, 110 is positioned on a playing surface 504, the goal opening 502 is positioned upright at approximately a 90-degree angle with respect to the playing surface 504. As shown, the top frame portion 104 includes a pair of top side-arm members 118 positioned adjacent, and coupled to (via releasably lockable hinge connectors 114) each end of a top cross-bar member 120.

The base frame portion 106 includes a pair of base side-arm members 126 and a base cross-bar member 128. Each of the base side-arm members is coupled to the lower end of the side post members 108, 110 on a first end and rearwardly extend therefrom to a second end positioned adjacent to respective ends of the base cross-bar member 128. The second end of each base side-arm member 126 is pivotably coupled to the ends of the base cross-bar member 128 via a releasably lockable hinge connector 114. Among other things, the base frame portion 106 supports the goal opening 502 in a substantially vertical position.

In addition to the side post members 108, 110, the top 104 and base 106 frame portions may be connected to one another via the middle post member 112. The middle post member 112 may be slidably coupled with the base cross-bar member 128 on a lower end and with the top cross-bar member 120 on an upper end via two or more collar mounting brackets 506. As shown, each collar mounting bracket 506 may include an internal cylindrical surface that snugly embraces the top 104 and base 106 frame tubular portions; however, the fit is loose enough to permit rotation of each bracket and thus the attached middle post member 112.

As shown, the middle post member 112 includes two more telescoping members having a plurality of spaced apart apertures 132 and a locking device 502 removably insertable therethrough when aligned. Each locking device 502 is configured to releasably hold the top frame portion 104 at a predetermined orientation relative to the base frame portion 106. By adjusting the middle post member 112 using the plurality of apertures 132 and the locking device 502, the orientation of the goal opening 502 may be easily adjusted to accommodate any irregularities in the terrain of the playing surface 504. In certain examples, at least one of the top frame portion 104, the side post members 108, 110 or the base frame portion 106 also include telescoping members for changing a height or a width of the goal opening 502, such as for allowing adjustment between a smaller and larger sized goal.

Figure 6:
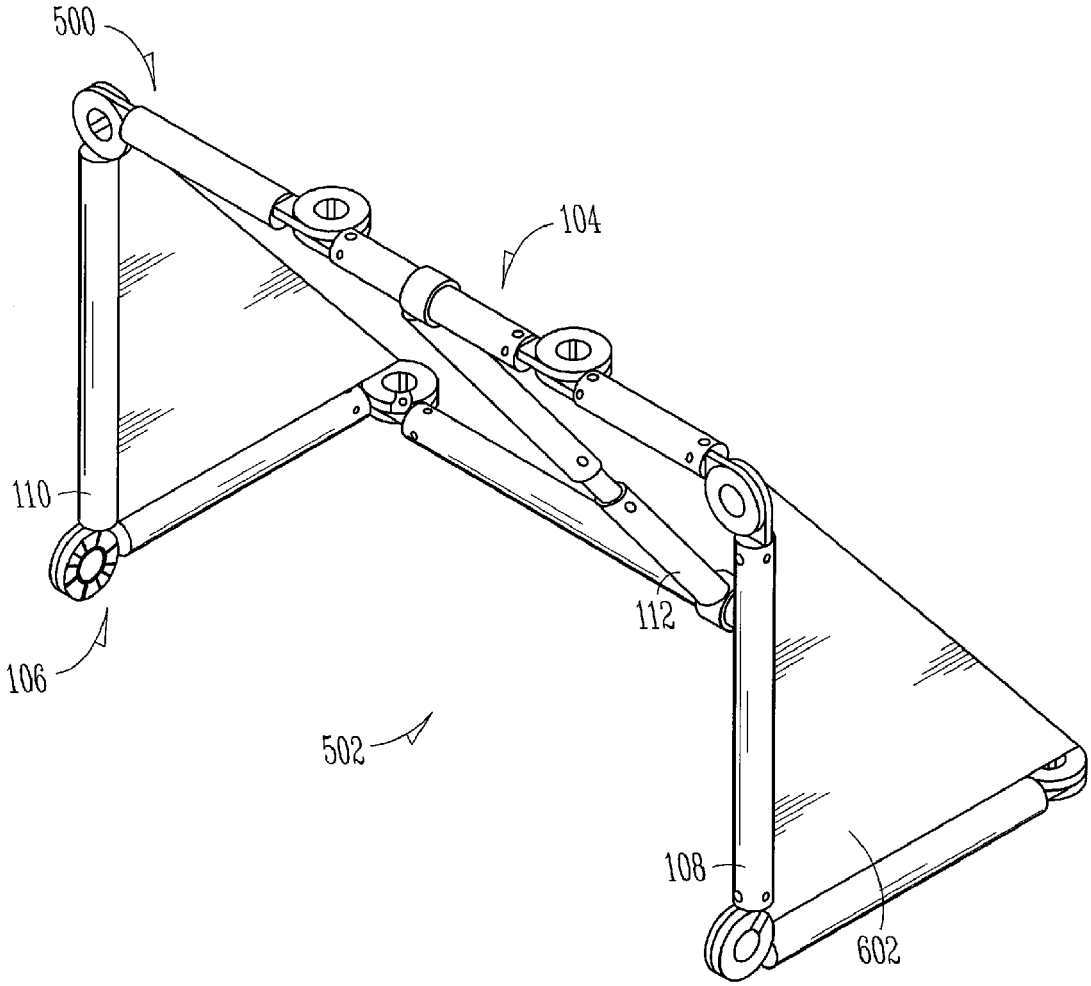
FIG. 6 is an isometric view of a portable goal assembly including an attached net for sporting recreation shown in an expanded configuration, as constructed in accordance with at least one embodiment.

As shown in FIG. 6, the goal assembly 500 further includes a net 602 configured to stretch across the sides and back of the assembly. In this example, the net 602 is attached to a first side post member 108, stretches across the back of the assembly 500 including over the optional middle post member 112, and ends at a second side post member 110. The net 602 may be attached to one or more of the side post members 108, 110, the middle post member 112, the top frame portion 104, or the base frame portion 106 by way of a quick-release connection scheme (e.g., hook-and-loop, magnets, chords, zip-ties, etc.), allowing for quick and easy set-up of the assembly 500. Alternatively, the net may be attached to the goal assembly 500 by weaving the net's mesh over the goal frame members.

Figure 8:
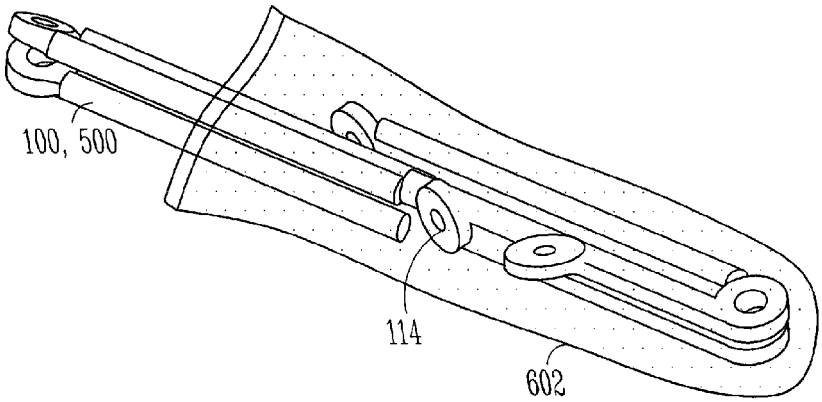
FIG. 8 is an isometric view of a portable assembly for sports skill development or recreation shown in a collapsed configuration within a storage bag, as constructed in accordance with at least one embodiment.

Several options for the net 602 are as follows. In one example, such as shown in FIG. 8, the net 602, in addition to enclosing portions of the goal assembly 500, may also be used as a carrying bag for the assembly. In another example, the net may include a material suitable for use in a goal assembly, such as nylon, polypropylene, or polyester. Possible uses for the goal assembly 500 include, among others, soccer, ice hockey, roller hockey, street hockey, lacrosse, or handball. While not shown, the goal assembly may include one or more spiked feet, non-slip contact pads, or spikes to stabilize an erect orientation of the goal opening 502 relative to the playing surface 504.

Figure 7A:
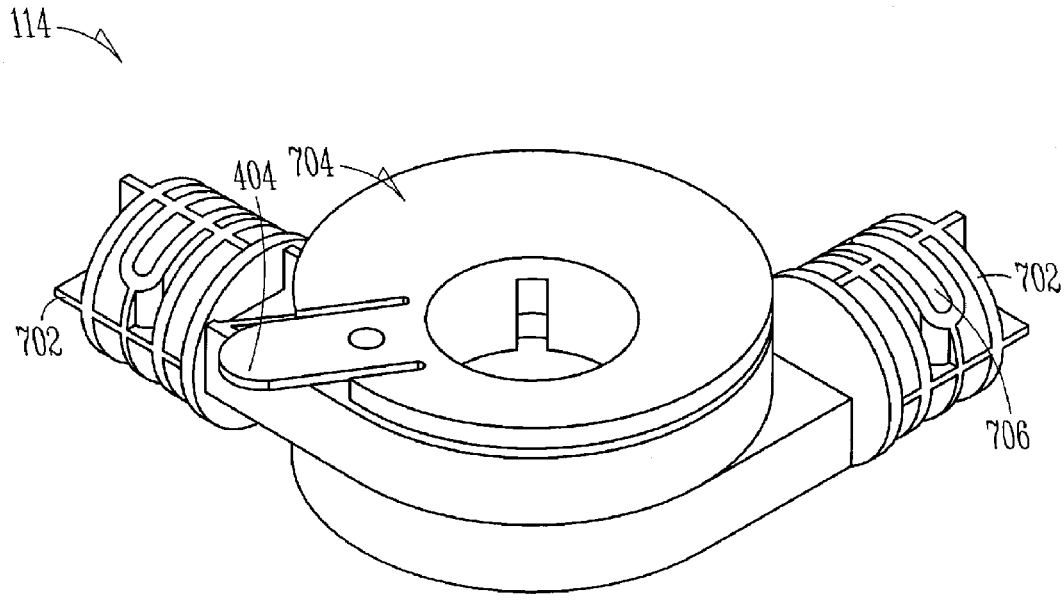
FIGS. 7A, 7B are isometric views of a releasably lockable hinge connector for use in a portable assembly for sports skill development or recreation, as constructed in accordance with at least one embodiment.
Figure 7B:
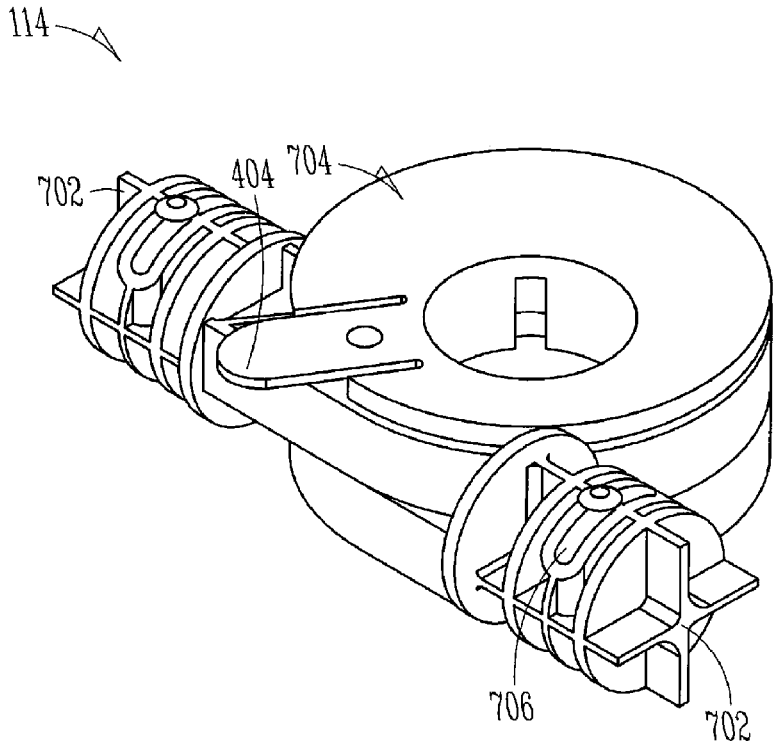

FIGS. 7A-7B are isometric views of one example of a releasably lockable hinge connector 114 for use in a portable assembly, such as a support assembly 100 (FIG. 1) or a goal assembly 500 (FIG. 5). In this example, the ends 702 of the releasably lockable hinge connector 114 include a cylindrical shape so-as-to be insertable into tubular members of the assembly frame (e.g., the top frame portion 104, the base frame portion 106, or the post members 108, 110, 112) and secured thereto (e.g., via a locking pin in conjunction with a define pin housing 706 or via friction). A center portion 704 of the hinge 114 is configured to releasably lock (via a locking tab 404) at one or more predetermined positions, as needed by the support assembly 100 configuration or the goal assembly 500 configuration. In addition to allowing multiple utility configurations, the pivotable hinges allow the assembly frame members to form a compact storage/portability orientation (see, e.g., FIG. 8).

As shown in FIG. 7A, the releasably lockable hinge connector 114 has a locked angular position of about 90-degrees, while the releasably lockable hinge connector 114 of FIG. 7B has a locked angular position of about 180-degrees. In certain examples, the hinge connectors 114 allow for angular rotation between about 0-degrees and 180-degrees; however, the present subject matter is not so limited. Advantageously, releasably lockable hinge connectors 114, an example of which is shown in FIGS. 7A-7B, allows for easy and safe manipulated of the support 100 or goal 500 assemblies.

As shown in FIG. 8, the portable assembly (i.e., the support assembly 100 or the goal assembly 500) may be collapsed and inserted into a carrying bag, such as a dual-purpose net 602. In certain examples, the assembly 100, 500 includes a collapsible tubular frame and releasably lockable hinge connectors 114, both of which makes the assembly easily portable and allows for easy storage of the same. For instance, when the assembly 100, 500 is not in use, the frame may be collapsed into a relatively small size and shape and placed into the dual-purpose net 602. In the example shown, the assembly 100, 500 is collapsible in a multi-dimensional manner. Advantageously, the assembly 100, 500 may be collapsed without disassembling or removing much, if any, component parts. As a result, the assembly 100, 500 may be set-up or taken-down quickly and easily without having to wrestle with the fitting of pieces or incurring possible loss of parts when the assembly is in storage mode or being transported.

Figure 9:
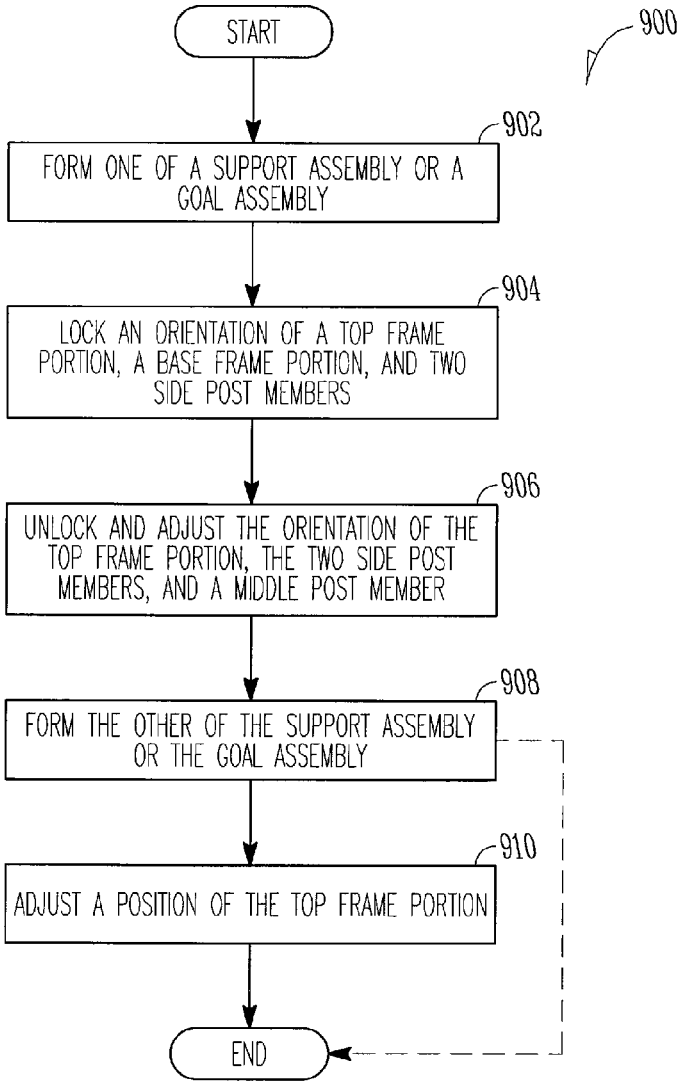
FIG. 9 illustrates a method of transforming a portable first assembly to a portable second assembly, as constructed in accordance with at least one embodiment.

FIG. 9 illustrates a method 900 of transforming a portable support assembly 100 (FIG. 1) to a portable goal assembly 500 (FIG. 5) or vice-versa. At 902, one of the support assembly 100 or the goal assembly 500 is formed. In certain examples, forming the support 100 or goal 500 assembly includes expanding a top frame portion 104 (FIGS. 1, 5), a base frame portion 106 (FIGS. 1, 5), two or more post frame members, such as three post frame members 108, 110, 112 (FIGS. 1, 5), and releasably lockable hinge connectors 114 (FIGS. 7A, 7B) from a compact orientation (see, e.g., FIG. 8). At 904, an orientation of the top frame portion 104, the base frame portion 106, and two side post members 108, 110 is locked using, in part, the releasably lockable hinge connectors 114. At 906, the orientation of the top frame portion 104, the two side post members 108, 110, and a middle post member 112 (FIGS. 1, 5) is unlocked and adjusted, such that at 908, the other of the support 100 or goal 500 assembly may be formed. Optionally, at 910, a position of the top frame portion 104 is changed by adjusting the middle post member 112. In one example, the position of the top frame portion 104 is changed to provide support to a user at a comfortable height.

Several options for the method 900 are as follows. In one example, forming the goal assembly 500 includes substantially aligning two top side-arm members 118 (FIGS. 1, 5) and a top cross-bar member 120 (FIGS. 1, 5) of the top frame portion 104. In another example, forming the support assembly 100 includes forming a generally U-shape with the two side-arm members 118 and the top cross-bar member 120. In yet another example, forming the support assembly 100 or the goal assembly 500 includes forming a generally U-shape with two base side-arm members 126 (FIGS. 1, 5) and a base cross-bar member 128 (FIGS. 1, 5) of the base frame portion 106.

The method illustrated in this disclosure is not intended to be exclusive of other methods within the scope of the present subject matter. Those of ordinary skill in the art will understand, upon reading and comprehending this disclosure, other methods within the scope of the present subject matter.

As discussed herein, a portable support or goal assembly includes, among other things, a top frame portion, a base frame portion, two or more post frame members, a plurality of releasably lockable hinge connectors or collar mounting brackets. The portable support assembly provides vertical support for a user and includes a generally U-shaped top frame portion configured to be gripped by the user and a generally U-shaped base frame portion having wheels or low-friction feet to facilitate mobility on a given support surface. The goal assembly provides a U-shaped goal opening defined by a longitudinally aligned top frame portion supported at each end by vertically extending side post members, the latter of which are attached to a U-shaped base frame portion.

Advantageously, the top and base frame portions, the post frame members, the releasably lockable hinge connectors, and the collar mounting brackets of the present assemblies are reconfigurable between the support assembly, the goal assembly, and a collapsed, compact orientation. As a result of its collapsible nature and optionally tubular design, each assembly is easily portable, i.e., easily movable from one location to another. For instance, each assembly may collapse so-as-to easily fit in a trunk or back seat of a car or may be strapped to a user's back. Among other advantageous characteristics, the present assemblies provide a simple and inexpensive construction which may easily be assembled for use by children and adults of various ages.

It is to be understood that the above description is intended to be illustrative, and not restrictive. For example, the above-described embodiments (or aspects thereof) may be used in combination with each other. Many other embodiments will be apparent to those of skill in the art upon reviewing the above description. The scope of the present assemblies and methods should, therefore, be determined with reference to the appended claims, along with the full scope of legal equivalents to which such claims are entitled. In the appended claims, the term "including" is used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, various features may be grouped together to streamline the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

What is claimed is:

1. A reconfigurable assembly comprising:

a top frame portion including at least two top side-arm members each having a first end and a second end with each of the second ends coupled to respective ends of a linking top cross-bar member;

a base frame portion including at least two base side-arm members coupled to respective ends of a base cross-bar member; and two or more post frame members coupled between the top frame portion and the base frame portion at an angle to a plane of the base frame portion, the two or more post frame members including two side post members;

wherein the top frame portion, the base frame portion, and the two or more post frame members comprise a support assembly configuration in a first instance with the at least two top side-arm members and the linking top cross-bar member defining a U-shape with an opening between the first ends of the top side-arm members dimensioned to allow a user to stand between the top side-arm members, and a goal assembly configuration in a second instance where the at least two top side-arm members and the linking top cross-bar member are substantially longitudinally aligned.

2. The reconfigurable assembly as recited in claim 1, including a net mountable to the top frame portion and the bottom frame portion wherein the net is configured to receive and store the assembly in a compact orientation when the assembly is not in use.

3. The reconfigurable assembly as recited in claim 1, wherein the at least two base side-arm members and the base cross-bar member comprise a generally U-shape in each of the first instance and the second instance.

4. The reconfigurable assembly as recited in claim 1, wherein an interior angle of the two side post members relative to the plane of the base frame portion is less than 90 degrees in the first instance and about 90 degrees in the second instance.

5. The reconfigurable assembly as recited in claim 1, wherein the two or more post frame members further include a middle post member comprising at least one telescopically adjustable member.

6. The reconfigurable assembly as recited in claim 1, wherein the coupling between the top side-arm members, the top cross-bar member, the base side-arm members, the base cross-bar member, and the side post members each include at least one adjustably lockable hinge connector configured to lock at a desired assembly orientation.

7. The reconfigurable assembly as recited in claim 1, wherein the top frame portion, the base frame portion, and the two or more post frame members comprise a tubular material.

8. The reconfigurable assembly as recited in claim 1, wherein the top frame portion, the base frame portion, and the two or more post frame members are collapsible into a compact orientation for facilitating portability or storage.

* * * * *